US009394811B1

(12) United States Patent
Farnelli

(10) Patent No.: US 9,394,811 B1
(45) Date of Patent: Jul. 19, 2016

(54) ALUMINUM OIL PAN FILTER BRACKET

(71) Applicant: Michael Louis Farnelli, Duncanville, TX (US)

(72) Inventor: Michael Louis Farnelli, Duncanville, TX (US)

( * ) Notice: Subject to any disclaimer, the term of this patent is extended or adjusted under 35 U.S.C. 154(b) by 319 days.

(21) Appl. No.: 14/215,020

(22) Filed: Mar. 16, 2014

Related U.S. Application Data

(60) Provisional application No. 61/801,842, filed on Mar. 15, 2013.

(51) Int. Cl.
*F01M 11/03* (2006.01)
*B03C 1/28* (2006.01)

(52) U.S. Cl.
CPC ..... *F01M 11/03* (2013.01); *B03C 1/286* (2013.01); *F01M 2011/031* (2013.01)

(58) Field of Classification Search
CPC ... F01M 11/03; F01M 2011/031; B03C 1/286
See application file for complete search history.

(56) References Cited

U.S. PATENT DOCUMENTS 5,314,625 A * 5/1994 Farnelli ..... B01D 21/0009 184/6.25
5,465,078 A * 11/1995 Jones, Jr. ..... B03C 1/286 184/6.25

* cited by examiner

*Primary Examiner* — David A Reifsnyder
(74) *Attorney, Agent, or Firm* — Guy V. Manning

(57) ABSTRACT

A magnet holding bracket has an rectangular body for holding a rectangular magnet as defined by the Magnet Patent. A mounting tab on one end of the rectangular body includes an aperture sized and physically disposed for insertion of an oil pan drain plug from a non-ferrous oil pan. The drain plug tightens against the mounting tab and holds the rectangular magnet in justaposition to the non-ferrous oil pan such that the rectangular magnet can engage ferrous particles circulating within the oil pooling in the non-ferrous oil pan.

16 Claims, 9 Drawing Sheets

ALUMINUM OIL PAN FILTER BRACKET

This application claims priority from Provisional Application Ser. No. 61/801,842, filed Mar. 15, 2013.

BACKGROUND OF THE INVENTION

1. Field of the Invention

This invention relates generally to oil filters for internal combustion engines, and particularly to micronic filters that utilize magnets to draw minute metal particles from engine oil supplies. More particularly, this invention relates to a bracket adapted to attach a micronic filter to an aluminum oil pan to which the magnetic filter otherwise cannot adhere.

2. Description of Related Art

U.S. Pat. No. 5,314,625 issued to Applicant, Michael Farnelli, on May 24, 1994, based on Application Serial No. 998,411 filed Dec. 29, 1992 (the "Magnet Patent"). The Magnet Patent describes a planar magnet with a C-channel housing adapted to magnetically adhere to a steel oil pan for an internal combustion engine. The Magnet Patent is hereby incorporated by reference in its entirety.

Many internal combustion engines these days, however, have aluminum or other non-ferrous oil pans in lieu of the more conventional steel oil pans. The magnetic filtering device of the Magnet Patent cannot adhere to such non-ferrous oil pans. A need exists for apparatus and method for adhering the magnetic filtering device of the Magnet Patent to non-ferrous oil pans and to other objects as appropriate for the intent and purpose of the Magnetic Patent.

SUMMARY OF THE INVENTION

A magnet holding bracket has a rectangular body for holding a rectangular magnet as defined by the Magnet Patent. A mounting tab on one end of the rectangular body includes an aperture sized and physically disposed for insertion of an oil pan drain plug from a non-ferrous oil pan. The drain plug tightens against the mounting tab and holds the rectangular magnet in juxtaposition to the non-ferrous oil pan such that the rectangular magnet can engage ferrous particles circulating within the oil pooling in the non-ferrous oil pan.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
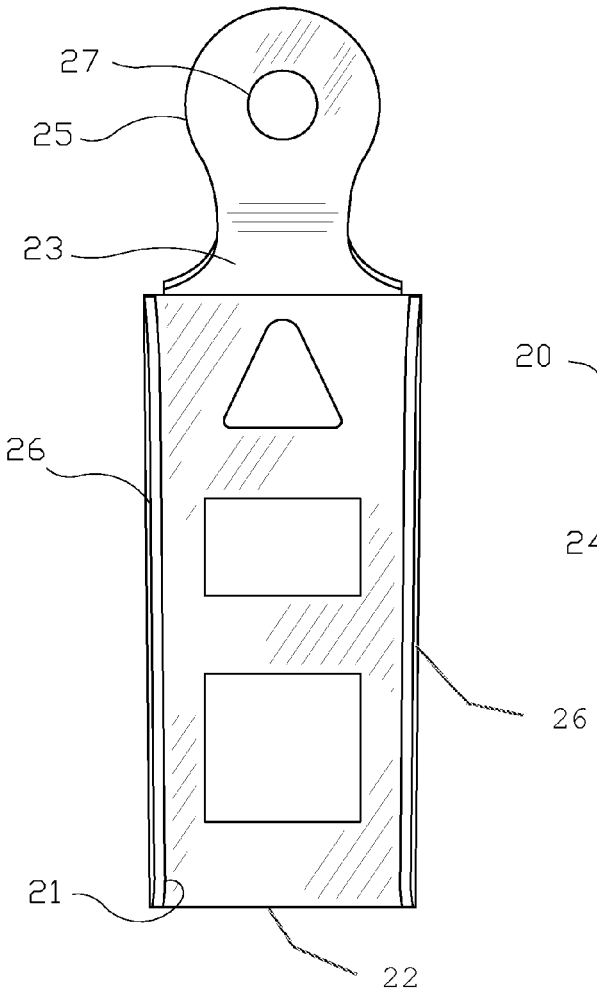
FIGS. 1-3, 5 show a preferred embodiment of the present invention in plan, left side, end and bottom elevational views, respectively.
Figure 3:
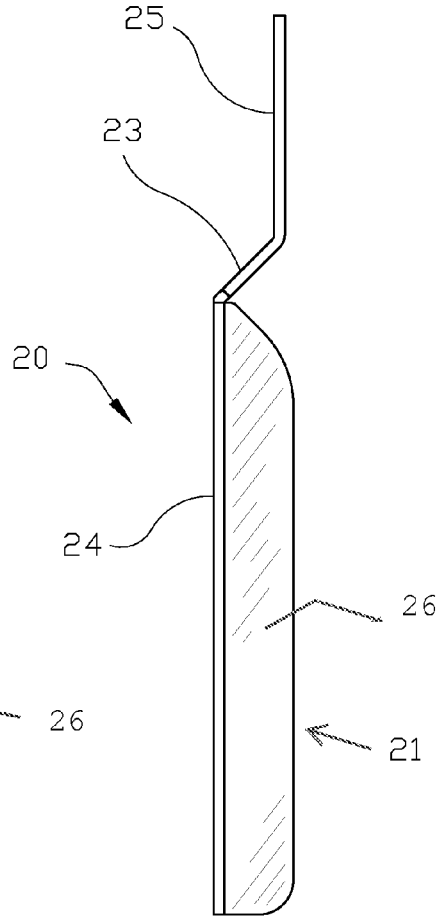
Figure 2:
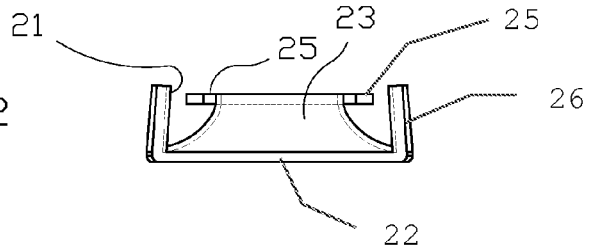
Figure 4:
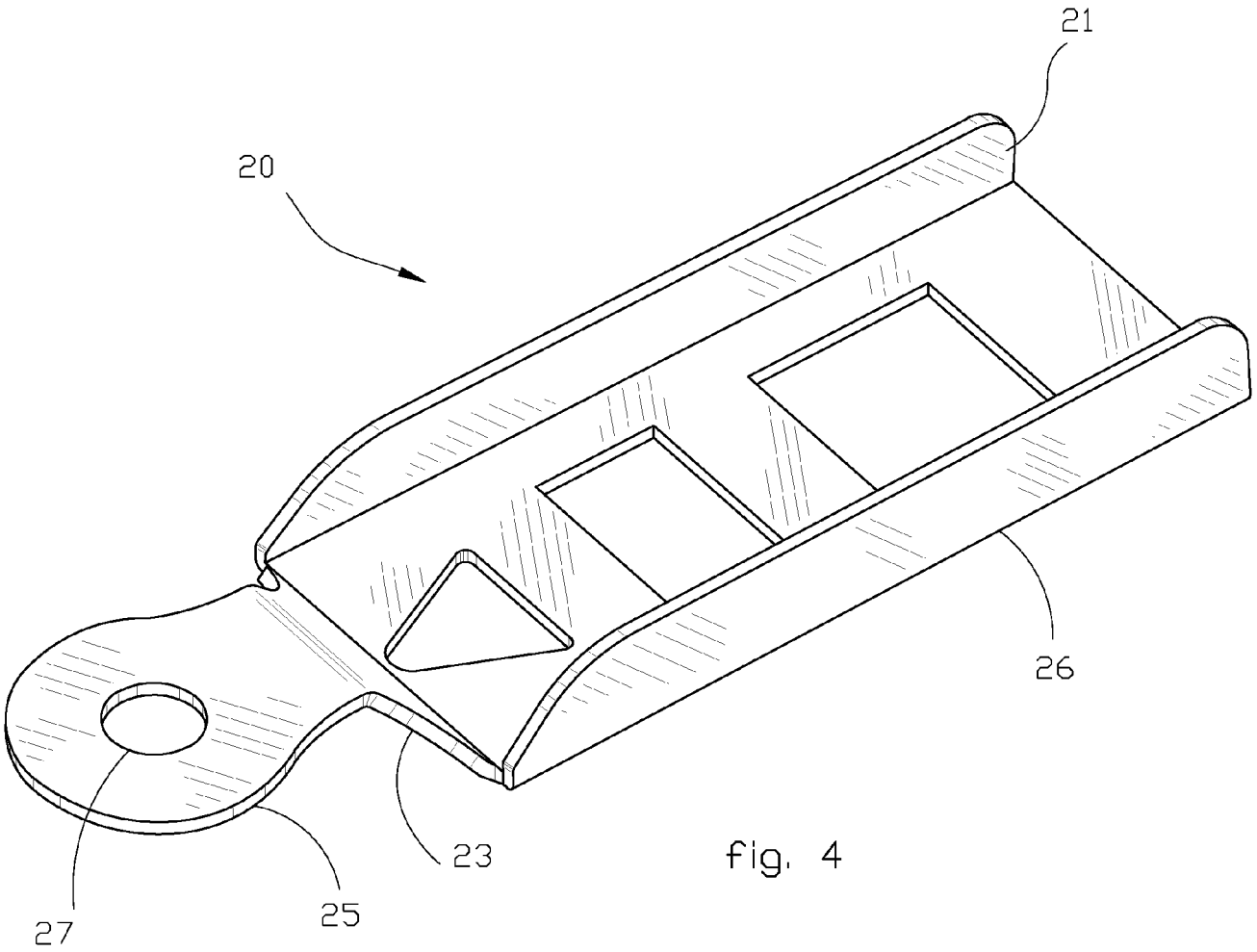
FIG. 4 shows the embodiment of FIG. 1 in a quartering perspective view.
Figure 5:
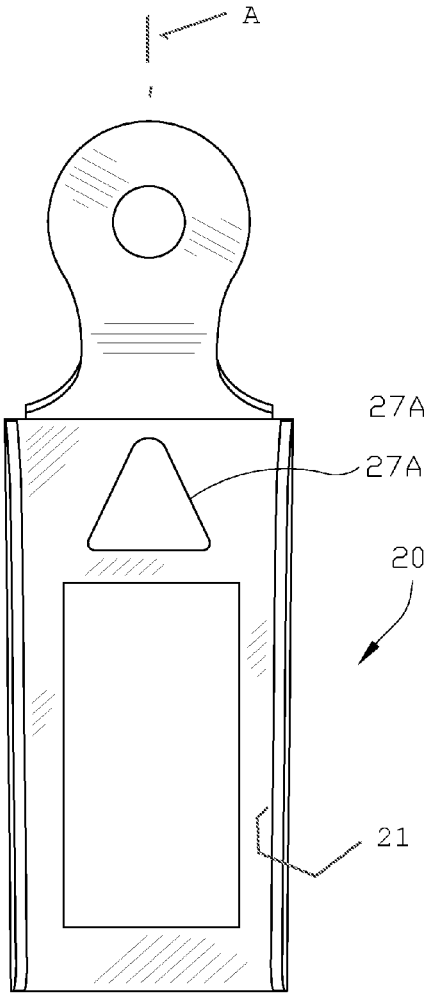

With reference now to the figures, and in particular to FIGS. 1-5, magnet holding bracket 20 comprises elongate, C-channel shaped body 21 having back 24 flanked by legs 26 and extending from butt 22 to head 25. Neck 23 couples head 25 to body 21, and eye aperture 27 is disposed within head 25 and longitudinally aligned with body 21 and neck 23. As depicted, neck 23 forms an offset to displace planar head 25 from being coplanar with back 24, but remaining parallel thereto. In many non-ferrous oil pans, the lug or aperture where drain plug 3 attaches is oriented such that drain plug 3 must be substantially normal to the plane occupied by back 24. Bracket 20 is adapted to hold one magnetic filter 10 in juxtaposition to non-ferrous oil pan 1 (see FIGS. 11-14).

Figure 6:
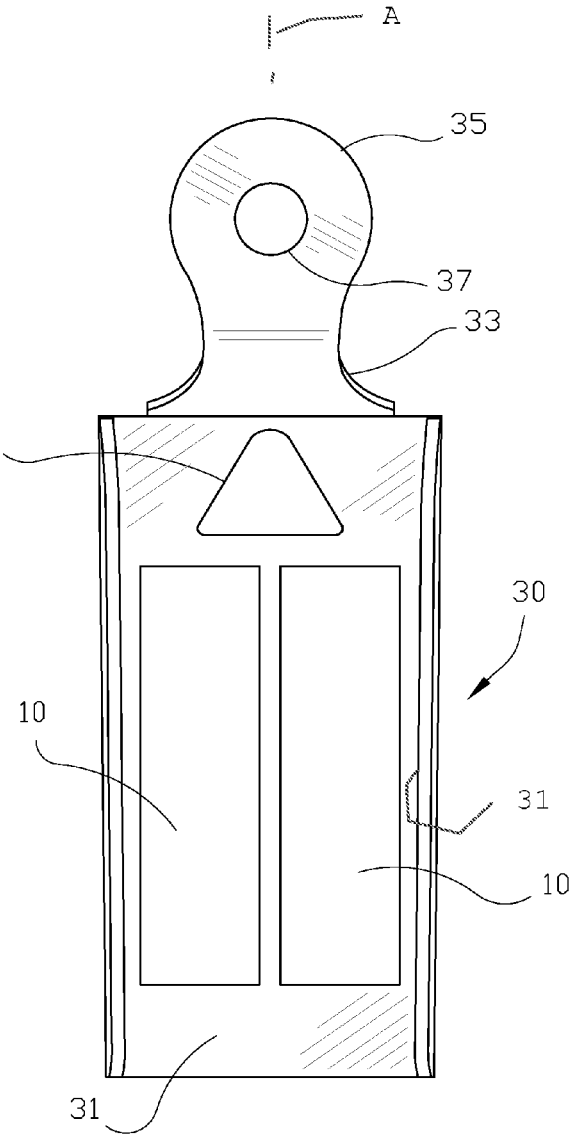
FIGS. 6-8 depict alternate embodiments of the present invention adapted to couple two, three and six rectangular magnets, respectively, to a non-ferrous object.
Figure 7:
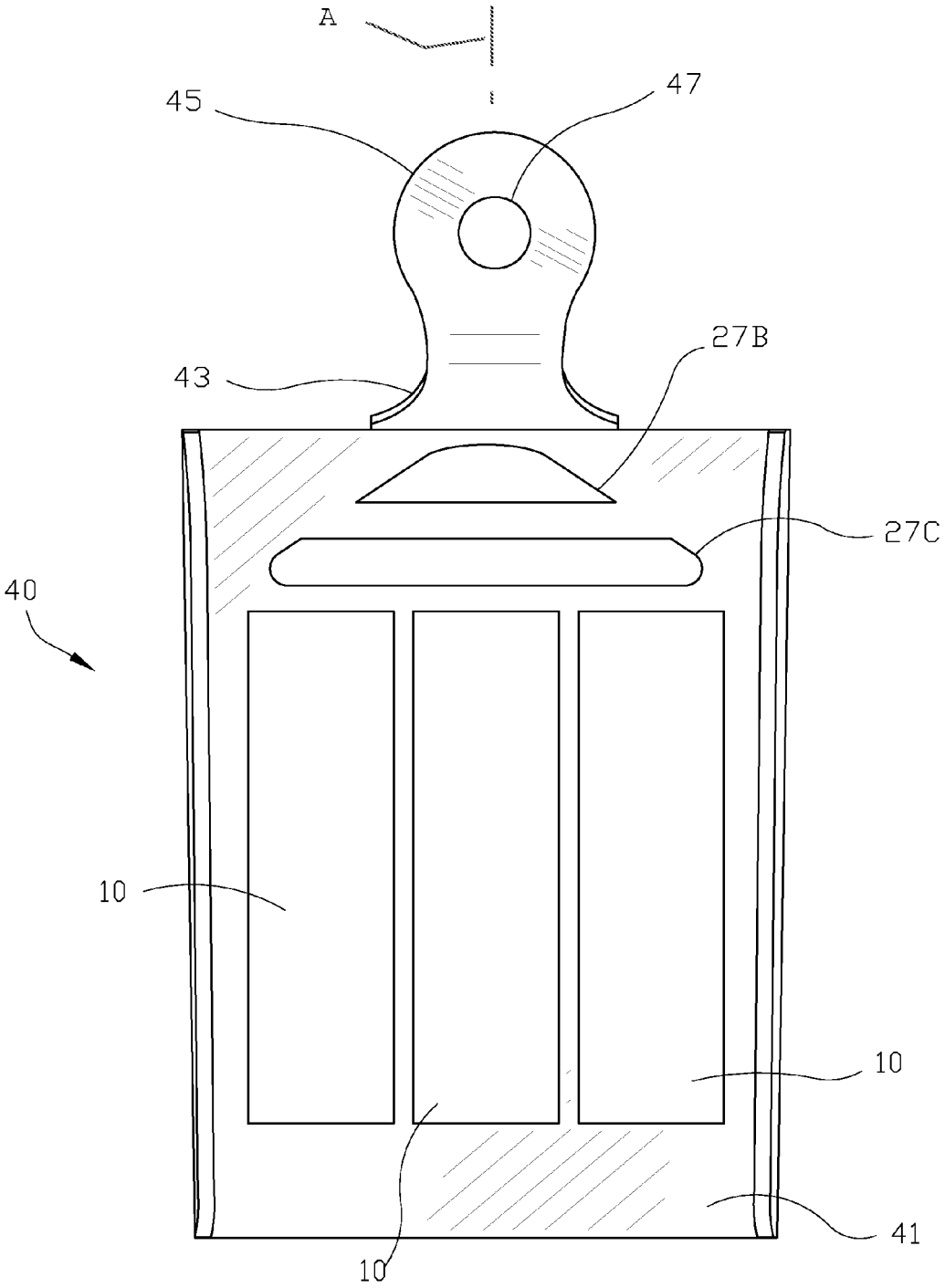
Figure 8:
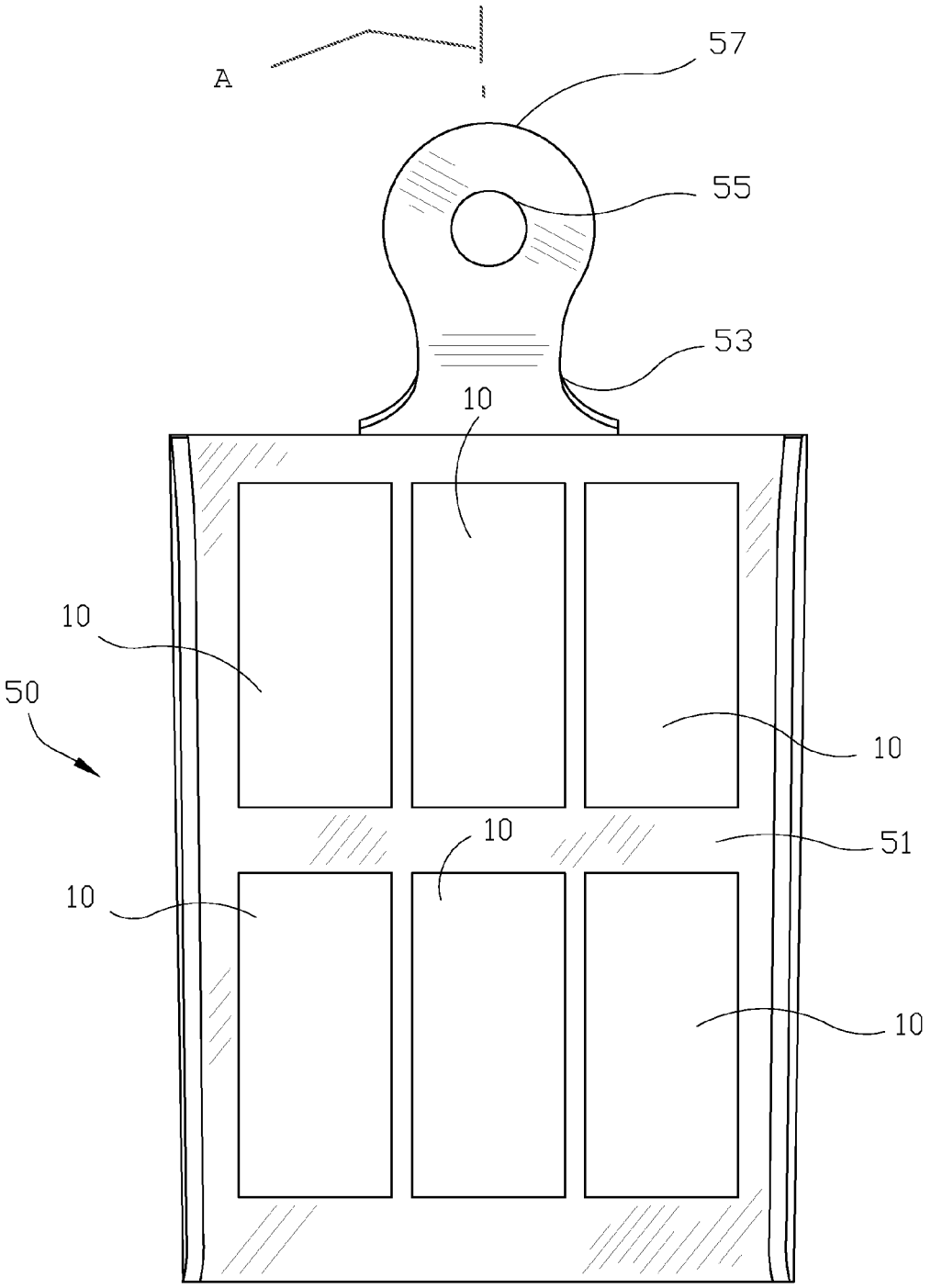

Turning now also to FIGS. 6-8, alternate embodiments of the present invention vary from bracket 20 by being capable of holding multiple magnetic filters 10 instead of a single one. In FIG. 6, bracket 30 holds two magnetic filters 10 disposed side-by-side and transverse a longitudinal axis A of bracket 30. This of course requires that channel 31 of bracket 30 be wider than channel 21 of bracket 20. In similar fashion, FIG. 7 depicts bracket 40 adapted to hold three magnetic filters 10 disposed side-by-side and transverse longitudinal axis A of bracket 40, again necessitating that channel 41 thereof be even wider. FIG. 8 depicts yet another embodiment of bracket 50 adapted to hold six magnetic filters 10 in two rows of three each, each row disposed side-by side and transverse longitudinal axis A of bracket 50. In this case, the geometry requires that channel 51 of bracket 50 be as wide as channel 41 of bracket 40, but twice as long.

Figure 9:
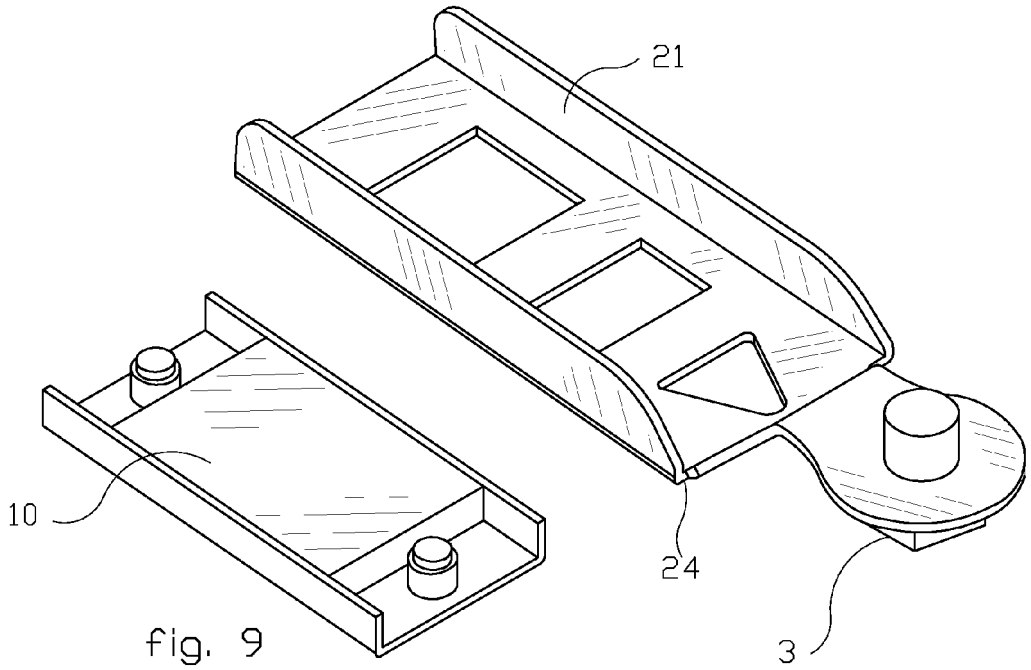
FIGS. 9-10 show an alternate embodiment of the present invention.
Figure 10:
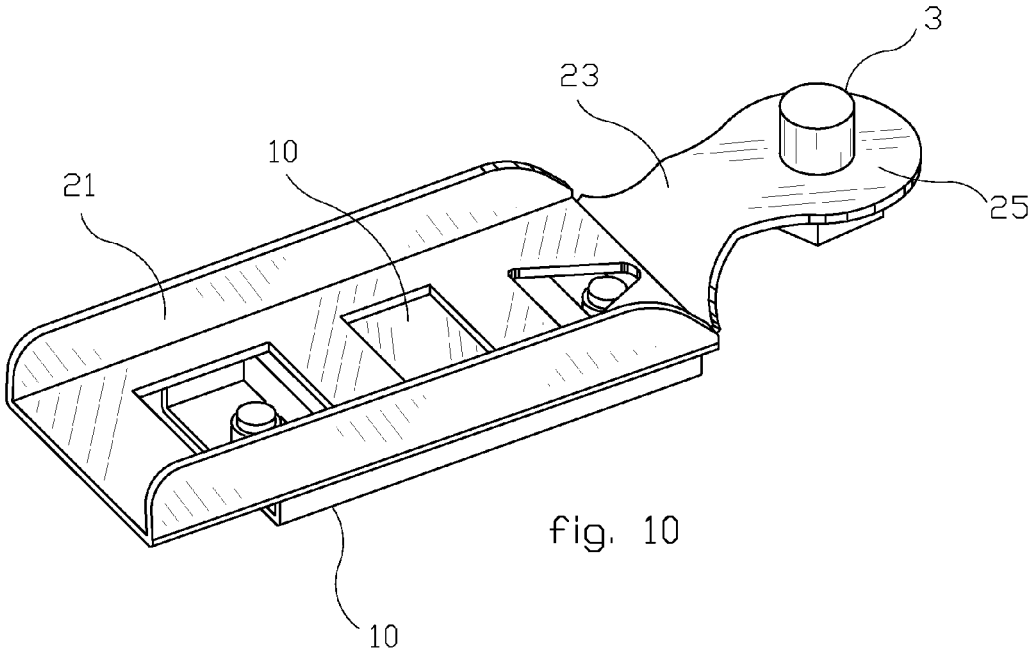
Figure 11:
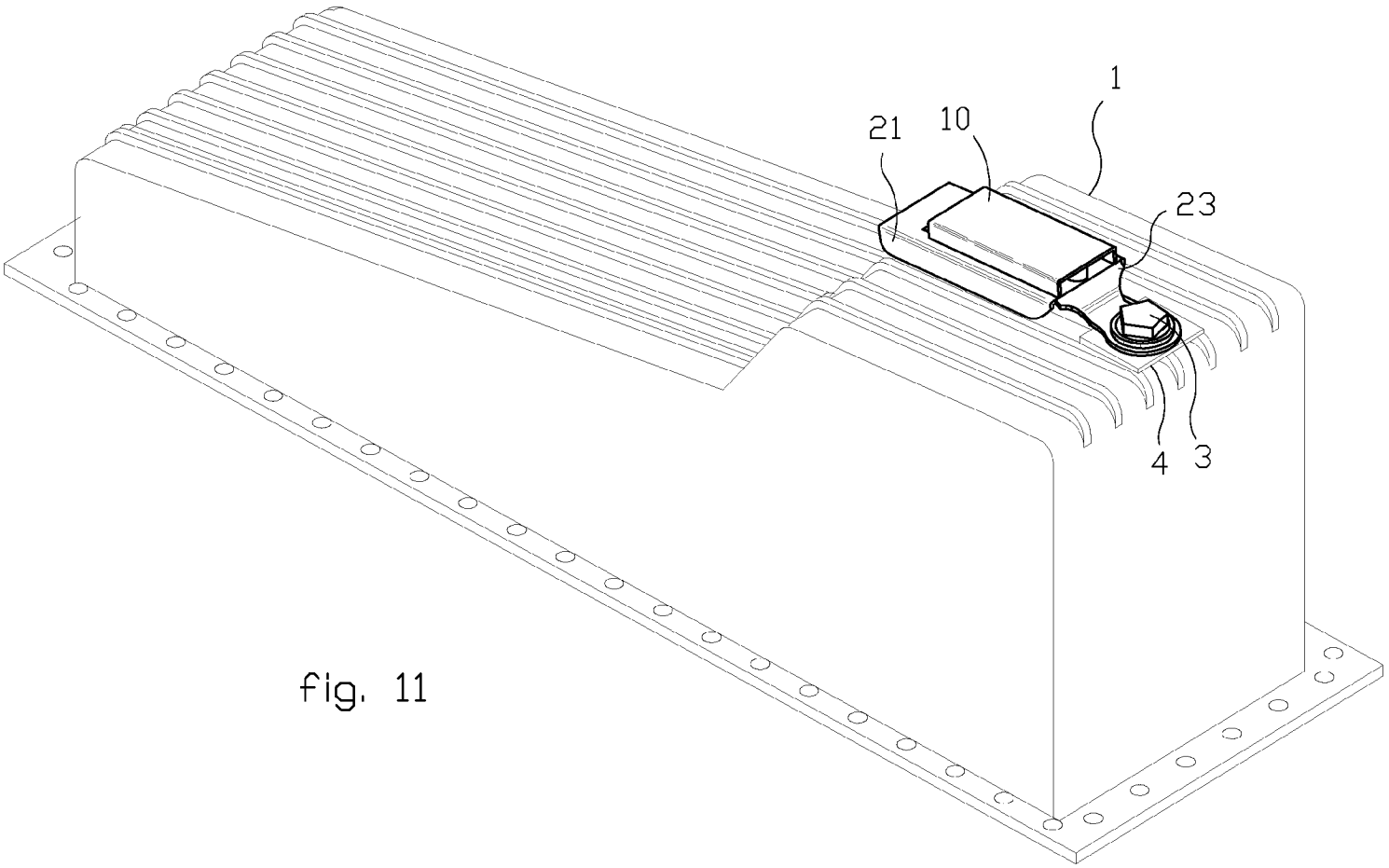
FIGS. 11-14 show various views of the present invention with a rectangular magnet properly mounted onto a non-ferrous oil pan.
Figure 12:
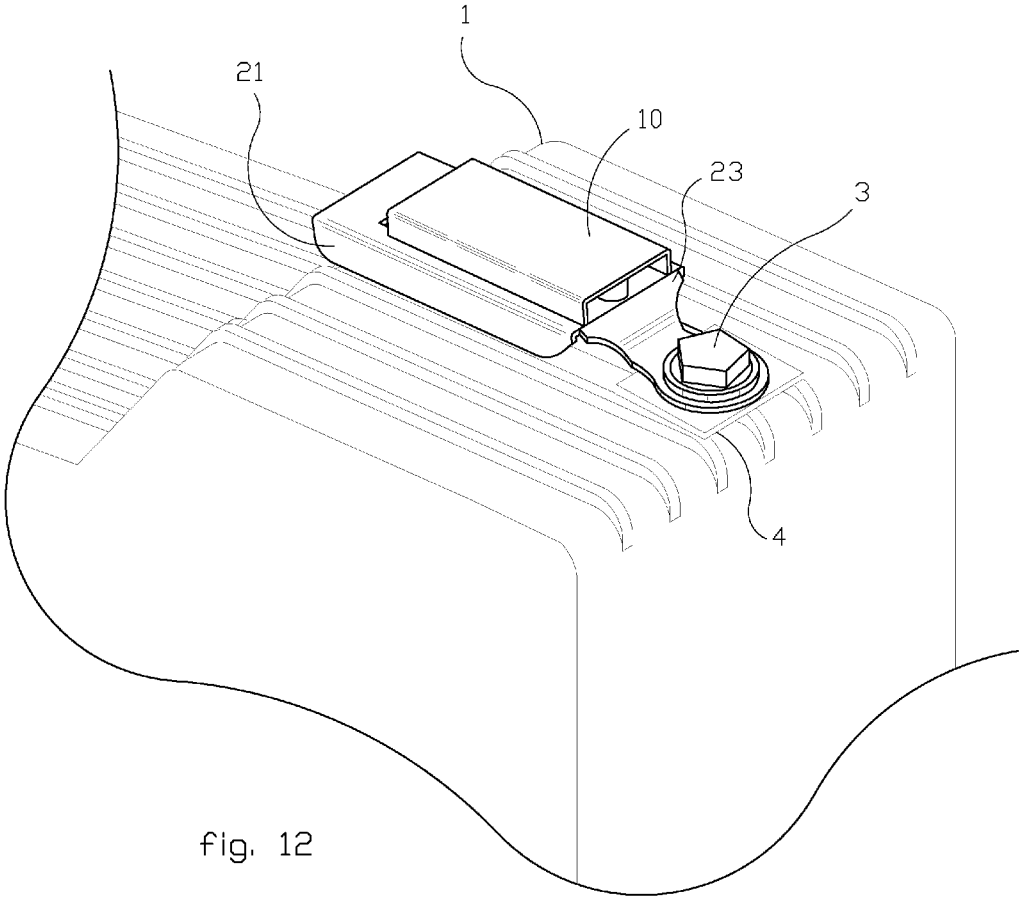
Figure 14:
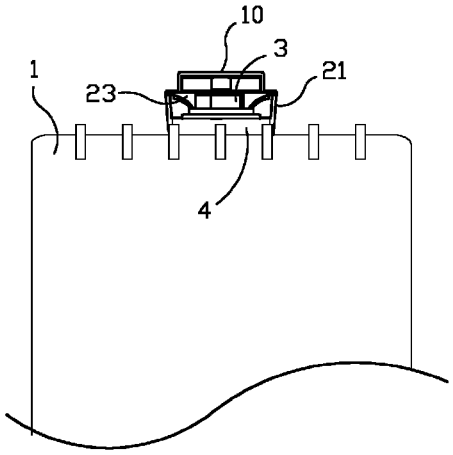
Figure 13:
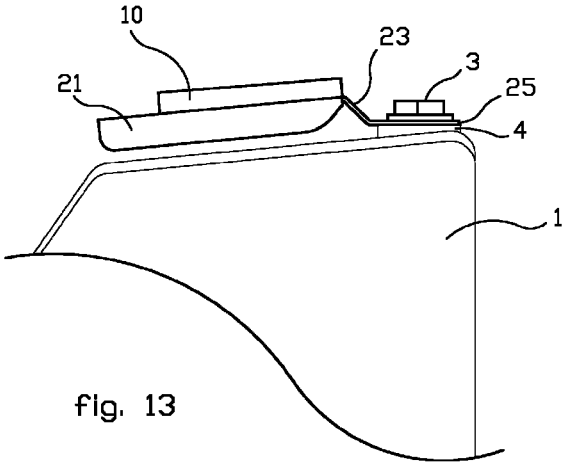

Turning now to FIGS. 9-10, the preferred embodiment of the present invention, bracket 20, is shown in various perspective views as having neck 23 disposed at an angle relative to back 24 instead of the parallel offset configuration of FIGS. 1-3, 5. In this case, the lug or drain hole into which drain plug 3 attaches is not positioned on the bottom of oil pan 1 but at an angle thereto, requiring that head 20 be disposed in a plane angled relative to the plane of back 24. One having ordinary skill in the art will recognize that many variations of this angle will be encountered, and that neck 23 must either be formed to reflect them or bent during installation.

Turning now to FIGS. 11-14, bracket 20 is shown installed on oil pan 1 and holding magnetic filter 10 in parallel juxtaposition to the bottom of oil pan 1 where it can attract ferrous shavings and particles within oil pooling on the bottom of oil pan 1.

The present invention, when used in conjunction with the above apparatus, enables magnetic filters 10 to cleanse oil pooling and circulating through non-ferrous oil pans 1. One having ordinary skill in the art will recognize that other uses for brackets 20, 30, 40, 50 may be derived from the principles and methods described herein.

While the invention has been particularly shown and described with reference to preferred and alternate embodiments, it will be understood by those skilled in the art that various changes in form and detail may be made therein without departing from the spirit and scope of the invention. For example, brackets 20, 30, 40, 50 have been presented as being used on non-ferrous oil pans, but they also could be employed just as well on oil pans of ferrous materials, or on other containers other than oil pans.

I claim:

1. A magnetic filter bracket for a non-ferrous oil pan, said oil pan being a reservoir disposed on an internal combustion engine for accumulating oil, said oil pan having an oil pan bottom and an oil pan drain plug coupled to said oil pan bottom, the filter bracket comprising a planar back having left and right sides symmetric about a longitudinal axis extending between a butt end and a head end, said planar back adapted to support at least one magnetic filter;

a neck having a proximate end and a distal end, said neck coupled by said proximate end to said head end and having a neck axis extending substantially coplanar with said longitudinal axis;

a head coupled to said distal end, said head surrounding and defining an oil drain plug aperture;

legs coupled to said left and right sides and disposed perpendicular to said planar back, said legs adapted to engage said oil pan bottom.

2. The filter bracket of claim 1 wherein said legs further comprise substantially planar walls extending from said butt end to said head end, said planar walls and said planar back defining a filter channel adapted to receive and support at least one magnetic filter.

3. The filter bracket of claim 2 wherein said filter channel is sized to receive and support a plurality of filter magnets.

4. The filter bracket of claim 1 wherein said head and neck are disposed coplanar with said planar back.

5. The filter bracket of claim 1 wherein said head is disposed in a head plane offset from a back plane defined by said planar back; and said neck extends at an angle to said back plane between said head end and said head.

6. The filter bracket of claim 5 wherein said head plane is parallel to said back plane.

7. The filter bracket of claim 1 wherein said planar back is adapted to support at least one magnetic filter.

8. The filter bracket of claim 7 wherein said planar back is adapted to support a plurality of magnetic filters.

9. The filter bracket of claim 1 wherein said oil pan drain has a drain axis perpendicular to said oil pan bottom; and said head is disposed in a plan substantially parallel to said oil pan bottom.

10. A bracket for attaching a magnetic filter to a non-ferrous oil pan, said oil pan having an oil pan drain plug, the bracket comprising a C-channel shaped body having a longitudinal axis extending between a butt end and a head end;

a neck coupled to said head end by a neck proximate end and extending to a neck distal end; and a head coupled to said neck distal end and extending substantially longitudinally away from said body, said head surrounding and defining an oil pan drain plug aperture.

11. The bracket of claim 10 wherein said body supports at least one magnetic filter.

12. The filter bracket of claim 10 wherein said head is disposed in a head plane offset from a body plane defined by said C-channel shaped body; and said neck extends at an angle to said body plane between said head end and said head.

13. The filter bracket of claim 12 wherein said head plane is parallel to said body plane.

14. An improved method of cleaning lubricating oil circulating in an internal combustion engine, said engine having an oil pan fluid communication with said lubricating oil, said oil pan having an exterior, an interior and a bottom, said oil pan adapted to accumulate said lubricating oil within said interior, said oil pan further having a drain communicating between said interior and said exterior, said drain having a drain plug journaled within said drain and adapted to seal said drain to retain said lubricating oil, the improved method comprising providing at least one magnetic filter adapted to attract small, ferrous particles circulating within said lubricating oil and to accumulate said ferrous particles at a select location within said interior;

providing a bracket adapted to mount said at least one magnetic filter to said oil pan, said bracket having a substantially rectangular body having a front and a back defined by two substantially parallel sides disposed symmetrically on opposite sides of a longitudinal axis extending between a butt end and a head end;

a plurality of legs disposed on said parallel sides and extending substantially perpendicular to said body;

a head coupled to said head end by a neck, said head surrounding and defining an drain plug aperture, said head thereby adapted to receive said drain plug journaled within said drain plug aperture; then disposing said at least one magnetic filter on said back and substantially aligned with said longitudinal axis;

removing said drain plug from said oil pan drain; then journaling said drain plug into said drain plug aperture; then replacing said drain plug into said drain with said bracket disposed adjacent said oil pan; then running said internal combustion engine to circulate said lubricating oil; then extracting said drain plug from said drain and said drain plug aperture; and then drawing said ferrous particles out of said oil pan interior.

15. The improved method of claim 14 wherein the drawing step further comprises employing said bracket to slide said at least one magnetic filter across said oil pan exterior from said select location to drain; and then attracting said ferrous particles through said drain to exterior said oil pan using said at least one magnetic filter.

16. The improved method of claim 14 wherein the drain is disposed on said oil pan a spaced distance from said bottom; and the improved method further comprises before the replacing step, bending said neck to cause said head to be disposed adjacent said drain with said drain plug aperture coaxial with said drain; and said rectangular body disposed adjacent said bottom.

* * * * *